US007497043B2

(12) United States Patent
Clifton, Jr. et al.

(10) Patent No.: US 7,497,043 B2
(45) Date of Patent: Mar. 3, 2009

(54) MAGAZINE DOUBLER

(75) Inventors: Norman E. Clifton, Jr., Jacksonville, FL (US); Brian R. Pond, Jacksonville, FL (US)

(73) Assignee: Prezine LLC, Jacksonville, FL (US)

( * ) Notice: Subject to any disclaimer, the term of this patent is extended or adjusted under 35 U.S.C. 154(b) by 329 days.

(21) Appl. No.: 11/405,728

(22) Filed: Apr. 18, 2006

(65) Prior Publication Data

US 2006/0242877 A1 Nov. 2, 2006

Related U.S. Application Data

(60) Provisional application No. 60/676,486, filed on Apr. 29, 2005.

(51) Int. Cl.
*F41A 9/61* (2006.01)

(52) U.S. Cl. ..... 42/49.01; 42/2; 42/7; 224/239; 86/47

(58) Field of Classification Search ..... 42/49.01, 42/2, 7; 224/239; 16/401; 30/510; 86/47; 124/45; 206/3; 131/242
See application file for complete search history.

(56) References Cited

U.S. PATENT DOCUMENTS 1,656,072 A * 1/1928 Lukens ..... 220/771
1,706,244 A * 3/1929 Meyerson ..... 131/242
3,453,762 A * 7/1969 Fremont ..... 42/50
3,623,256 A * 11/1971 Shiplee ..... 42/50
4,484,404 A * 11/1984 Johnson ..... 42/90
4,628,627 A * 12/1986 Johnson ..... 42/90
5,279,059 A * 1/1994 Howard ..... 42/90
5,676,241 A * 10/1997 Degoix et al. ..... 206/3
6,202,908 B1 * 3/2001 Groover ..... 224/239
6,212,815 B1 * 4/2001 Fitzpatrick ..... 42/90
6,634,131 B1 * 10/2003 Fitzpatrick ..... 42/90
6,668,479 B1 * 12/2003 Obong ..... 42/90
D502,524 S * 3/2005 Fisher et al. ..... D22/108
6,874,266 B1 * 4/2005 Kong ..... 42/71.01
7,073,285 B2 * 7/2006 Obong ..... 42/90
2007/0289189 A1 * 12/2007 Oehri ..... 42/49.01

* cited by examiner

*Primary Examiner*—Michael Carone
*Assistant Examiner*—Samir Abdosh
(74) *Attorney, Agent, or Firm*—Arthur G. Yeager

(57) ABSTRACT

A magazine doubler includes a resilient body with two cavities each having upstanding ribs to carry magazines therein at different heights. A bracket and spaced screws are mounted medially between the front and back of the body to squeeze the body to generally conform it to carried magazines therein. A blocking element is used to replace the top round in one magazine to prevent the upper round from being dislodged during use of the doubler. Such element is tethered and biased by a rubber band looping around one of the screw shanks.

20 Claims, 6 Drawing Sheets

MAGAZINE DOUBLER

CROSS-REFERENCE TO RELATED APPLICATION

The present invention is related to provisional application 60/676,486 filed Apr. 29, 2005 entitled "MAGAZINE DOUBLER" by the present inventors.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

This invention relates to affixing multiple ammunition magazines to each other during use. Specifically, magazines are attached side-by-side so that while one magazine is fully inserted in the gun, one or more auxiliary magazines are retained in a location convenient for fast and efficient insertion into the gun.

2. Relevant Art

Magazines are supplied independently and are intended to be used one at a time by the operator or shooter. Historically, the operator, usually a soldier or officer, would have to eject the magazine from the gun and reach somewhere on his/her person to obtain another loaded magazine and then place the new magazine into the magazine receiver. This operation takes a considerable amount of time and requires that the user take the focus off of the target to execute this multi-step operation. Many times the original empty magazine is also lost in this process because of the urgency required to get back to shooting.

Several other devices have been conceived to address this problem, but they failed to address several key requirements. Specifically, these devices allowed the user to attach two magazines to each other, but not in any fixed location, relative to one another. The user could slide the magazines up and down relative to one another. This was fine to initially fit the magazines, but then they would typically slide relative to one another in use and, in many cases, the second magazine could not be inserted once it was needed, in a critical situation. The secondary magazine could slide up during use in the case of resting the gun on the ground, as will happen while shooting in the prone position, which could allow one of the magazines to interfere with the gun or the ammunition casing ejection port door. This interference prevents the second magazine from reaching its seated position so the gun cannot function.

The final problem that was not addressed by the prior art is that the top bullet in the auxiliary magazine tends to work its way forward due to the sudden backward acceleration (recoil) of the gun during use. If the operator inserts the secondary magazine into the magazine receiver with the top bullet protruding forward slightly, a jam will likely occur that would temporarily render the weapon useless. The time that it would take to clear the jam could be critical to the safety and well-being of the soldier or officer. Accordingly, an ammunition control device in the form of a blocking element takes the place of the top round in a magazine and inhibits movement or dislodging of rounds in the spare magazine.

What is desired in a magazine holder is the following. First, a device should locate two magazines side by side in a precise location in all three dimensions. The device should be constructed in such a manner to minimize any chance of slippage of the magazines, relative to one another. In addition, the device should contain a bottom support so that if the user rests the bottom of the magazine on the ground, no load is placed on either magazine relative to one another and no slippage will occur. Multiple fasteners should be used to ensure a secure attachment of one magazine to the other.

A separate blocking element fits into the top of the auxiliary magazine to prevent dirt and debris from getting into the magazine as well as hold the top round down far enough so that it could not slide or be dislodged forward during use. This element can be easily ejected with one hand for a quick magazine change.

Because many individuals use the magazine to rest the gun on the ground or other surface while shooting, this article should have a radiused surface to rest on the ground. This surface will enable the user to easily maneuver the gun while shooting and protect the magazine case that would otherwise be in direct contact with the ground or hard surface.

U.S. Pat. Nos. 5,279,059; 6,327,805; and 6,796,074 are representative of the prior art.

BRIEF SUMMARY OF THE INVENTION

In one aspect of the present invention there is provided a magazine doubler for carrying dual elongate magazines for ready use with a firearm comprising a body having front and rear portions and side walls defining a pair of magazine cavities for receiving respective lower ends of first and second magazines therein, each cavity being formed by front and rear walls, an upper opening, and a bottom wall, the body being formed of a resilient material substantially conformable to each magazine received in respective cavity. Securing means is disposed against front and rear portions of the body for forcibly squeezing the body to generally conform the body to outer surfaces of installed magazines to securely retain such magazines disposed in the cavities. Also included is at least a pair of spaced upwardly disposed rib members integral with the bottom wall of one cavity for contacting a bottom of a magazine disposed therein for positioning such magazine at a predetermined height with respect to another magazine disposed in another cavity. The other bottom wall of other cavity has at least a pair of spaced upwardly disposed rib members for contacting a bottom of a magazine disposed therein for positioning the height of such magazine at a predetermined height with respect to the upper opening of the other cavity. At least a pair of rib members in one cavity extend upwardly a distance greater than other at least a pair of rib members in the other cavity to provide that a magazine disposed in one cavity extends upwardly a greater height than a magazine disposed in the other cavity.

Other aspects of the invention provide securing means that includes spaced elongate members and a bracket mounted against the rear walls of the cavities, the securing means further includes a plurality of flanges adjacent the front walls of the cavities, the elongate members being defined by a plurality of threaded fasteners mounted between the bracket and each flange to force the bracket against the rear walls and to force the front walls against magazines carried within the cavities. The bracket includes a substantially rectangular plate having inside and outside surfaces, a pair of spaced parallel bracket walls projecting laterally from the interior surface, a plurality of laterally extending bosses are disposed between the bracket walls, each boss having an opening therethrough disposed in alignment with the respective fasteners for passage of the respective fastener therethrough. The rear portion of the body includes a pair of spaced rear walls and a plurality of recessed vertically spaced walls continuous with and disposed between said rear walls of the body, each rear wall of the body carrying one of the pluralities of the flanges. The pair of spaced bracket walls is locatable between the rear walls of the body to provide contact between the interior surface of the plate and the rear walls. The bottom wall of the body is arcuate in shape from one side wall to the other side wall.

In another aspect of the present invention there is provided a magazine doubler for carrying dual elongated magazines disposed side-by-side for ready use with a firearm comprising a flexible body including front and rear portions and side walls having a first and second cavity for receiving respective lower ends of first and second magazines therein, each cavity being defined by a substantially flat front wall and an arcuate rear wall, an upper opening, and a bottom wall, one bottom wall of the first cavity having a plurality of upwardly disposed spaced ribs for contacting a bottom of a magazine disposed therein for positioning such magazine at a predetermined height with respect to another magazine disposed in another cavity, and securing means disposed against the front and rear portions of the body, movable to compress against the front and rear portions to retain such magazines disposed in said cavities between the front and rear portions of the body. The bottom wall of the second cavity has a plurality of upwardly disposed spaced ribs for contacting a bottom of a magazine disposed therein for controlling the height of such disposed magazine with respect to the upper opening of the second cavity. Each rib in one cavity extends upwardly a distance greater than other ribs in the other cavity to provide that a magazine disposed in the first cavity extends upwardly a greater height above the upper opening of the first cavity than the height above the upper opening of the second cavity of a magazine disposed in the second cavity. The securing means includes spaced members and means for selectively moving the members to squeeze against the front and rear walls to generally conform the cavities to magazines in said cavities to secure magazines disposed in the cavities. The ribs are three in number and disposed adjacent each front wall and rear wall and are integral with respective bottom wall of each corresponding cavity for contacting a bottom of a magazine disposed therein for positioning such magazine at a predetermined height with respect to another magazine disposed in another cavity. There is also a medially located boss member integral with an upwardly disposed from each bottom wall, the height of each boss being substantially equal to the height of the ribs in respective said cavity for supporting the floor plate of a magazine disposed in respective cavity. An ammunition control device is included for preventing the dislodging forwardly of the top round in a magazine and has a blocking element locatable in the top space in a magazine. The ammunition control device includes a biasing member attached to the securing means for pulling the blocking element away from magazine when the element is moved out of the top space in a magazine.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE INVENTION

Introduction

Figure 3:
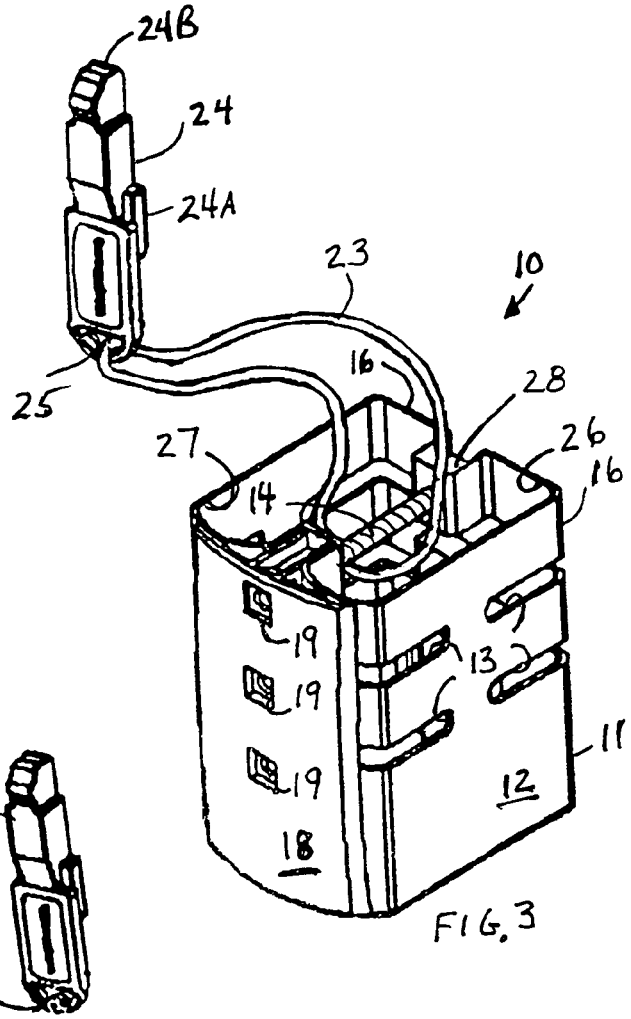
FIG. 3 is a perspective view of the assembled magazine doubler in accordance with the present invention.

The "Magazine Doubler" (MD) is formed as a dual magazine holder which according to the present invention is designed to provide operators with the ability to quickly and efficiently reload their rifles with a second magazine without compromising the reliability of the weapon. Other devices that clamp or strap magazines together do not insure that the proper staggering of the magazines will be maintained, nor do they protect the top round form the extra magazine from being dislodged forward during combat use. Both of these problems can cause malfunctions that would negate the advantage of having the spare magazine attached to the primary magazine. The MD uses fixed standoff points molded into the carrier to prevent the magazines from moving relative to each other. The strong molded nylon case uses three bolt-through connectors to insure that the magazines are locked in place, even after repeated aggressive loadings or dropping of the magazines to the ground. A "Top Round Protector" (TRP) is used to prevent the top round in the extra, unprotected magazine from being unintentionally dislodged forward of the front edge of the magazine due to the firing of the weapon. One round from the extra magazine is removed and the TRP is loaded in its place. The TRP is removed quickly by applying thumb pressure down and forward on the top rear release tab. The TRP is normally released before the start of the reloading cycle so that the hand used to control the magazines can be moved down near the bottom of the MD unit before the rifle's magazine latch has been activated. When the MD has been assembled and the TRP put in place, an unloaded MD unit should be locked into place on the weapon to see if there is any interference between the TRP and any type of mount on the upper receiver. Any interference can normally be fixed by moving the mount forward or aft.

Operation

Fully load both magazines. Determine which magazine will be the primary and which will be the reload. A right-handed shooter will start with the right magazine loaded in the rifle and the reload to his left. The left-handed shooter will choose the opposite magazine to start loaded. Once the primary magazine has been determined, at least one round is removed from the reload magazine. Most experienced combat operators remove two rounds from a reload magazine to insure the seating of a magazine with the bolt closed. The TRP 24 is now loaded in the reload magazine just like a cartridge, in the direction of the pictured cartridge on the top. On AR-M16 type weapons, the leading ledge of the TRP 24 goes inside the front lip of the magazine to secure the TRP 24 in place. The charged magazine is ready for use. Shooters need to practice the reload maneuver over and over until it is an immediate, automatic action. When a reload is necessary, the first action necessary is to remove the TRP 24 while the magazines are secured in the weapon. Use the thumb of the support hand, and push the back top of the TRP 24 down and forward at the same time. The TRP 24 should eject forward unless there is interference with some type of mount on the top of the upper receiver. The TRP 24 does not have to eject clear, it only has to be released. The support hand should now move down and grip the reload side of the doubler allowing enough clearance to reload the unit without trapping the fingers between the grip and the lower receiver. Once a secure grip is formed, the weapon's magazine latch should be pressed and the magazine change completed. If the TRP 24 has been released but trapped by some type of mount, it will jettison clear when the primary magazine and the unit are released from the magazine well.

Construction

Figure 1:
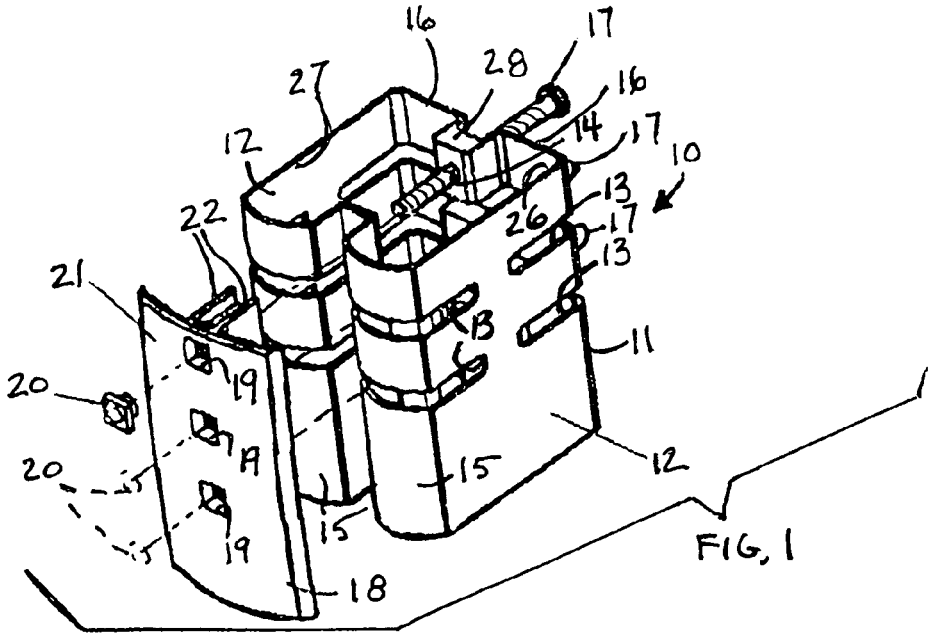
FIG. 1 is an exploded view of the magazine doubler in accordance with the present invention.
Figure 7:
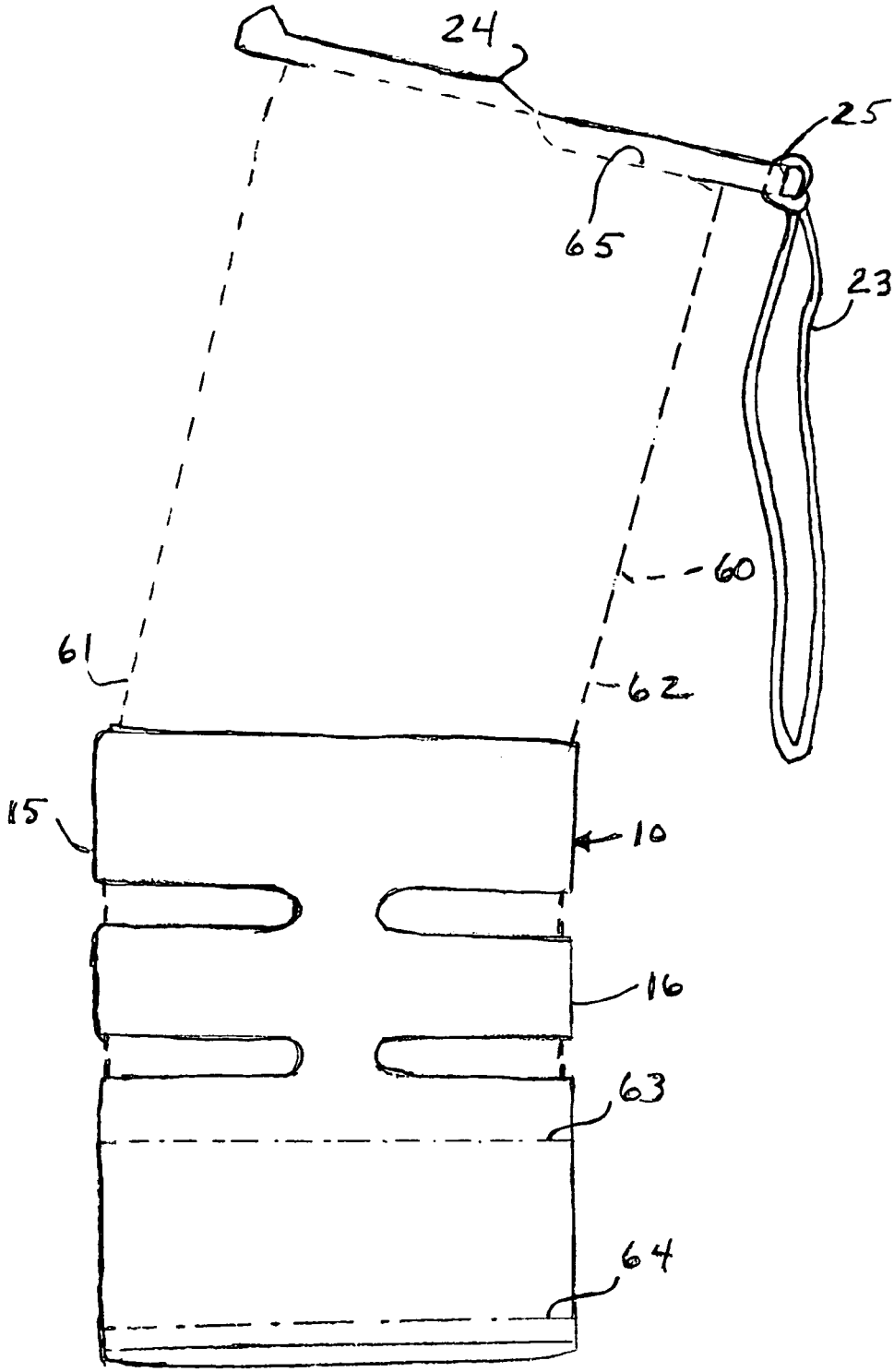
FIG. 7 is a pictorial view of a magazine carried at two heights in the magazine doubler including a top round protector in accord with the present invention.

With respect now to the drawings, an exploded view of the major components of the magazine doubler 10 is shown in FIG. 1. A unitary nylon case body 11 includes side walls 12 with a plurality of wrap around slots 13 to provide flexibility and three fasteners in the form of slotted screws or bolts 14 having head 17 and being threaded in part away from head 17. Curved rearward walls 15 define vertical recess 15A that generally conform to the curved wall 61 of a magazine clip 60 (FIG. 7). Flat walls 16 conform generally to the flat wall 62 of a magazine clip 60.

Magazines 60 are secured in place by a clamp in between walls 15 and 16 in the form of screws 14, screw heads 17, threaded nut plates 20 and nut plate retainer 18 to adjust the holding force of the case body 11 around magazines 60 as will be discussed hereinbelow. Screws 14 thread into one of three nut plates 20 that includes a non-circular plate carrying a round threaded passageway that fit within generally square recesses 19 formed into a nut plate retainer 18 that itself fits into recess 15A formed by a pair of spaced parallel interior flange walls 22. The outside wall 21 of retainer 18 is smooth to minimize interference with clothing, etc.

Figure 2:
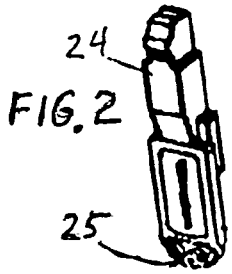
FIG. 2 is a perspective view of the top round protector in accord with the present invention.

Lanyard 23 in the form of a rubber band fits through opening 25 in top round protector (TRP) (FIGS. 2-3), which acts as an ammunition control device in to prevent the dislodging forwardly of the top round in a magazine 60. Lanyard 23 is connected around the top screw 14.

Figure 5:
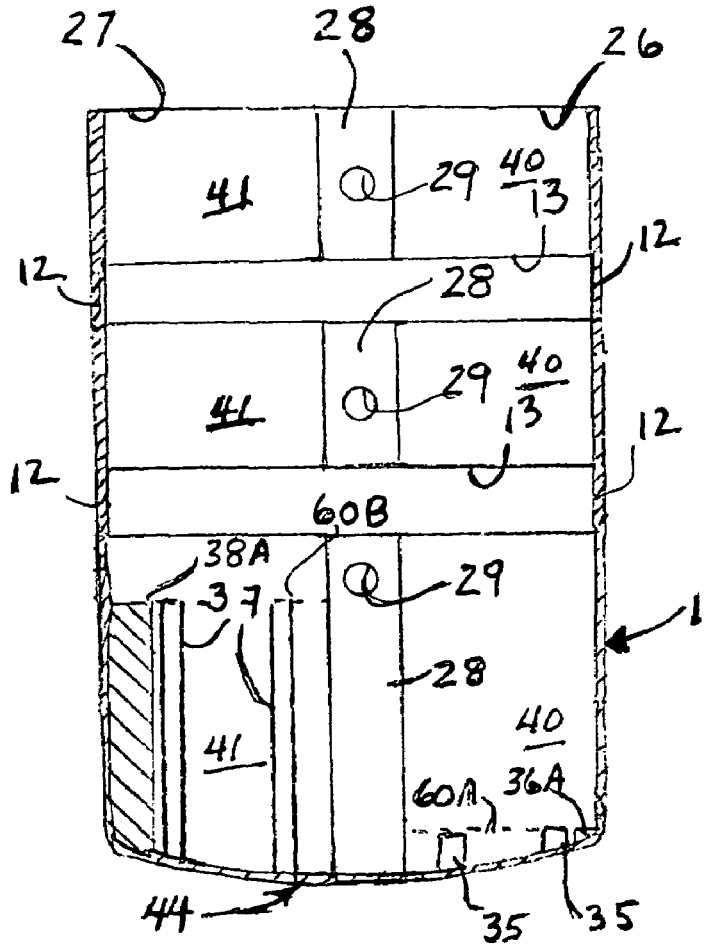
FIG. 5 is a cross-sectional view of the case body taken along the lines 5-5 of FIG. 4.
Figure 4:
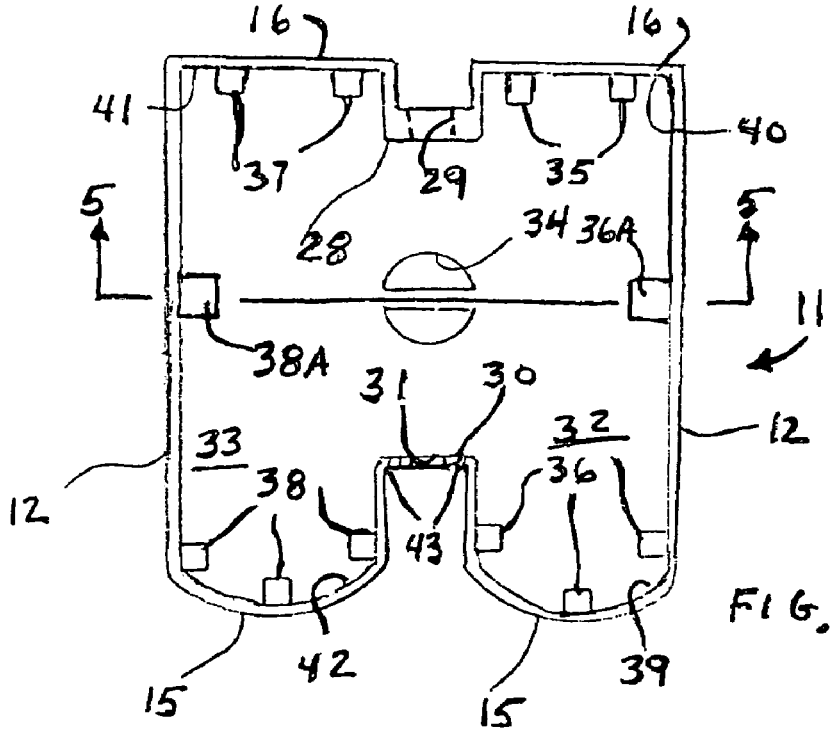
FIG. 4 is a top view of the case body of the magazine doubler of FIG. 1 in accordance with the present invention.

FIGS. 4 and 5 illustrate further details of case body 11. In FIG. 4, a top view of body 11 shows two cavities 26,27 having respective bottoms 33, 32 (with opening 34 therethrough) to accommodate magazines 60. Lines 60A and 60B represent the bottoms of installed magazines 60. Flanges 28 are arranged vertically and include screw passageways 29. Wall portions 30 include screw openings 31 for carrying screws 14 therethrough.

Short height limiting ribs or bosses 35, 36 in cavity 26 provide height control of a magazine 60 (FIG. 7, line 64). Ribs or bosses 37, 38 in cavity 27 are greater in vertical height to provide magazine 60 positioning as shown in FIG. 7 (line 63). Interior surfaces 39, 40, 41, and 42 and holes in wall portions 30 further define the body 11.

Preferably, additional ribs or bosses 36A and 38A are located medially and provide support of the bottom of a magazine 60 against deformation because of magazine spring pressure.

The magazine-doubling device 10 has the ability to support the magazine's removable floor-plate using the magazine height/alignment stops 35, 36, 37, 38 that are incorporated into the design:

1) These magazine positioning support bosses 35-38 prevent damage to the floor-plate of the magazine by putting the drop impact load on the magazine's vertical walls not the floor-plate.

In addition, there is also extreme spring pressure when the magazine is fully loaded. When the fully loaded magazine is ejected form the gun the impact with the floor and the compressed spring pressure can bend the center of the floor-plate where it is not supported by magazine design. The magazine manufacturers provide rolled over tabs extending down from the magazine's vertical walls that are located near the front and back of the magazine's floor-plate, which provides no support in the center section of the magazine.

2) The doubler design also incorporates a side-to-side radiused bottom in the form of an arcuate bottom surface 44 to assist the user in using the gun while it is resting on a surface.

Figure 6:
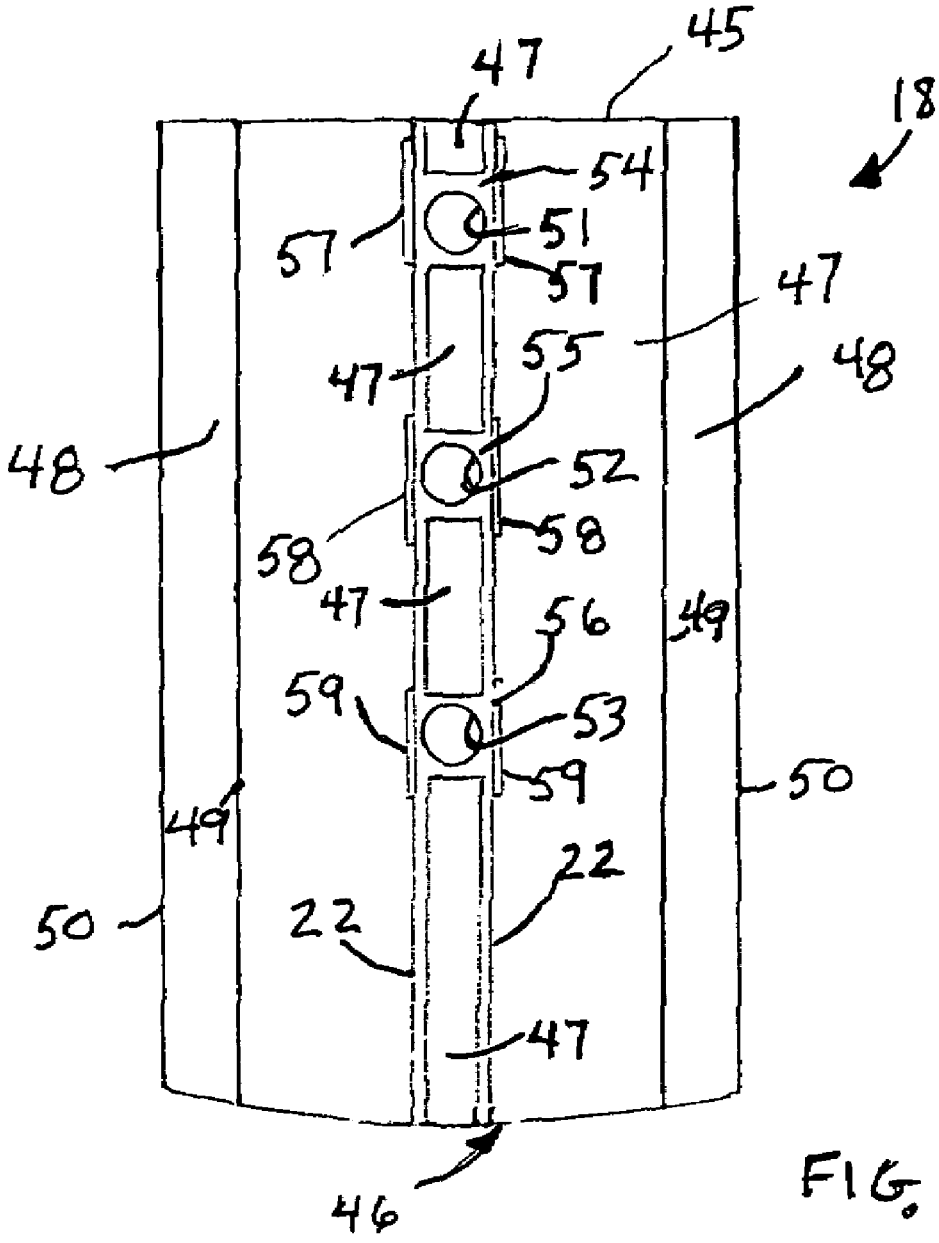
FIG. 6 is an elevational view of the nut plate retainer of FIG. 1 in accordance with the present invention.

FIG. 6 illustrates a clamp bracket in the form of the nut retainer plate 18 shown from the inside surface 47. The top 45 and bottom 46 (which corresponds to surface 44) defines a vertical height substantially the same as that of case body 11. Panel portions 48 are curved and become thinner outwardly from lines 49 to edges 50 to provide a match to walls 15.

Parallel spaced vertical walls 22 project laterally and provide bosses 54-56 that have openings 51-53 therethrough. Spaced bosses 57-59 mate closely with recess 15A to provide a snug fit therebetween. Screw openings 51-53 communicate with recesses 19 for screws 14.

Figure 8:
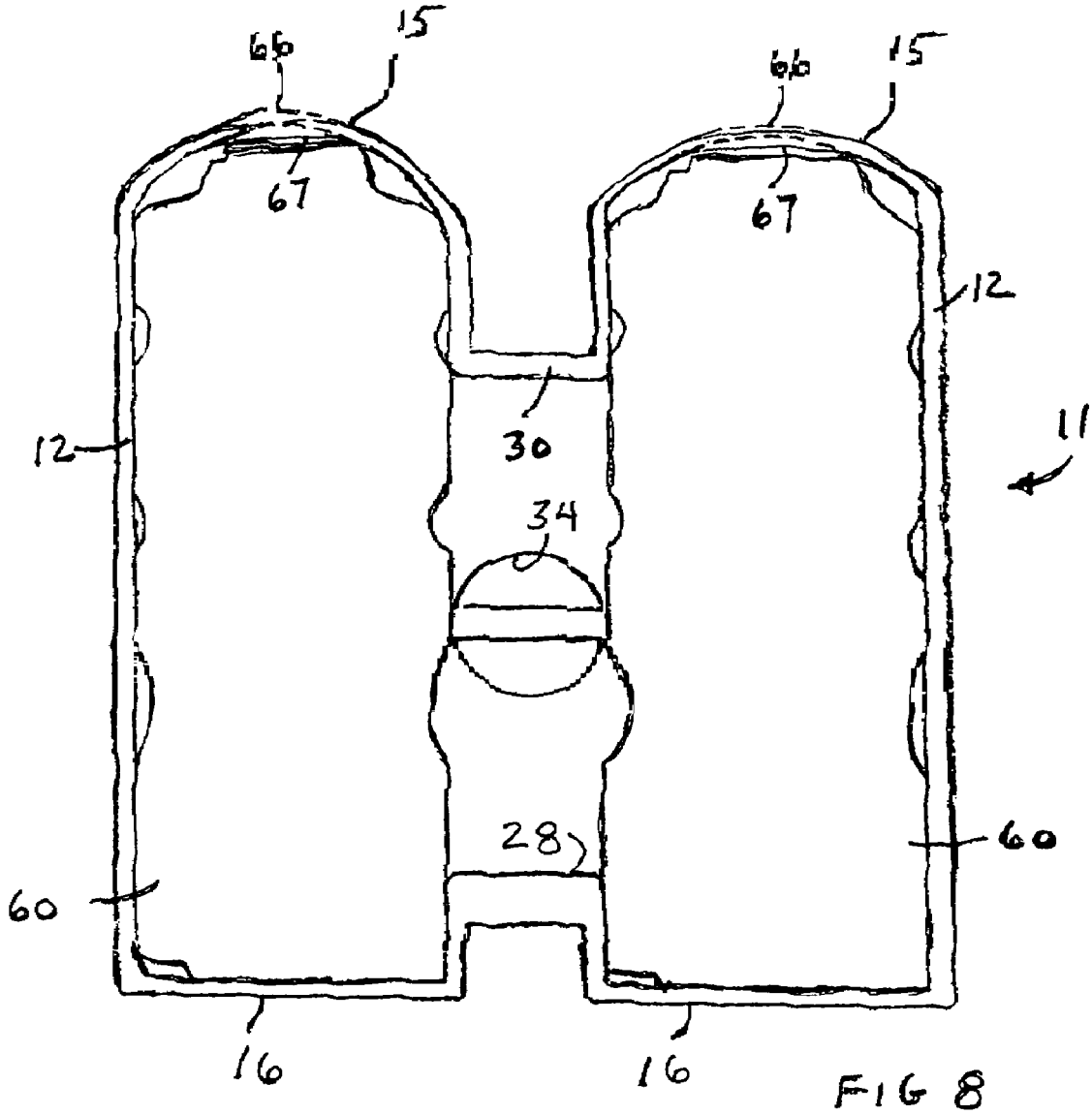
FIG. 8 is a pictorial view of the conformance of the case body to magazines secured therein wherein the conformed shape is shown in solid line and the initial shape is shown in broken line.

FIG. 8 illustrates the conformance of the case body 11 around magazines 60 as it "sets" at room temperature from the initial broken line 66 form to the final solid line form 67.

Assembly

The doubler 10 is provided in component form and is assembled as follows:

1. The nut plate retainer 18 is placed on the rear of the case body 10 (rounded side 15) so that the three square holes or recesses 19 of the retainer 18 line up with the opposing three holes 29 of the case body 10 (flat side 16).
2. Loop tie the black rubber band 23 through the eyelet 25 of the TRP 24. Insert one nut plate 20, (flat side to the outside) in the top hole 51 of the nut plate retainer 18. Pass one of the threaded machine screws 14 through the top hole 29 of the case body 10 while capturing the open end of the black rubber band 23 which is loop tied to the TRP 24. The rubber band 23 should be moved to the front of the case near walls 15. Secure the top screw 14 by threading about two turns into the top nut plate 20. The length of band 23 is set to pull TRP 24 out of the way when the TRP 24 is moved out of magazine 60 by a user.
3. Install the second and third nut plates 20 and machine screws 14 by threading each about two turns.
4. Start an unloaded magazine 60 base down matching the flat front 62 and the rounded back 61 of the magazine 60 with the respective front and back (FIG. 7). While rocking fore and aft, push the empty magazine 60 down firmly until it reaches a positive stop against respective bosses 35, 36 or 37, 38. Repeat the same process with a second magazine 60. (Note magazines 60 that have a sharp base that is deformed or otherwise damaged through repeated droppings may need to be dressed with a metal file.)

Figure 9:
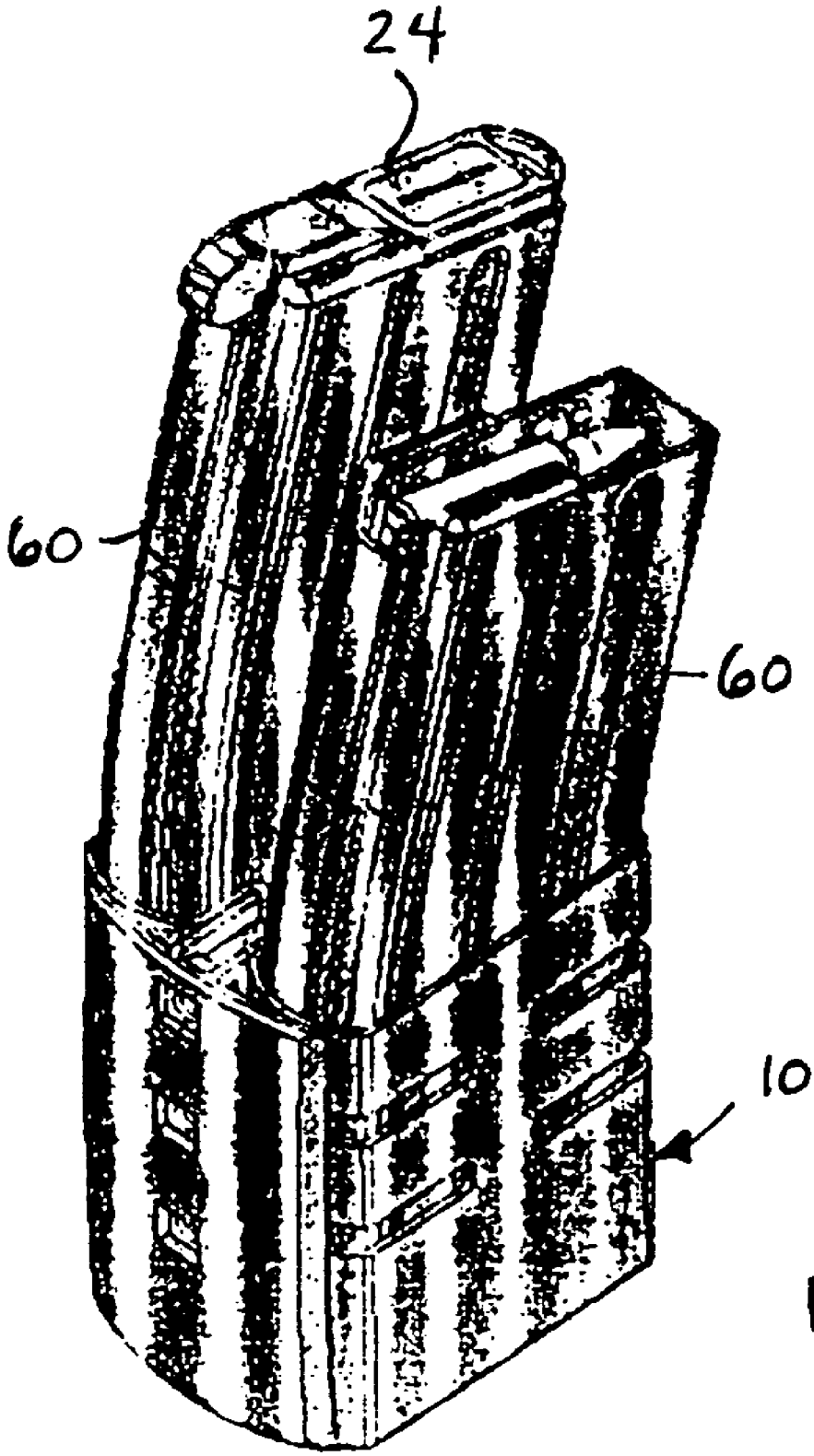
FIG. 9 is a pictorial illustration of the device ready for use.

5. Tighten the top screw 14 until the magazines 60 are difficult to slide out. Normally this is when the screw 14 protrudes about two threads past the flat end of the nut plate 20. Duplicate the same torque on the bottom screw 14 and nut plate 20 and then finish with the middle screw 19 and nut plate 20. Do not over tighten. The mechanical advantage of the screws can damage the magazines if over tightened.
6. The nylon material used in case body 11 will take an initial set and will conform to the magazines 60 in about two days if exposed to normal room temperature (FIG. 8). The device 10 with installed magazines can be used immediately but a final tightening should be accomplished after the set has taken place. This will require the initial torque and is normally about two turns of each screw. Before use, the magazines should be tested without the use of a rifle. Fully load both magazines, then using the back flat end of the TRP 24 against the flat base of the exposed round, strip out each round. Check to see that each round advances with a snap action and there is no sluggish delay.
7. The device 10 is ready for use as illustrated in FIG. 9.

The screws 14 are preferably of a sufficient pitch to allow for small incremental tightening of the front and rear walls 16 and 15 respectively against magazines 60 to provide for the desired securing force of the case body 11.

The top round protector 24 is formed as a blocking element to fit into a magazine in place of the top round. The specific shape of the TRP 24, such as bosses 24A under an upper lips of a magazine and thumb knob 24B, may vary with the specific type of magazine 60 that is being used. Biasing means in the form of rubber band 23 is used to rapidly pull the TRP 24 out of the way when it is released from a magazine 60 by user action against thumb knob 24B. Rubber band 23 is looped around eyelet 25 at one end. The other end is looped around top screw 14, but may be attached at any other appropriate point.

Case body 11 and plate 18 are formed of nylon and have a flat black finish or other coloring and/or finish as may be desired in a specific application.

While the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

What is claimed as new and what it is desired to secure by Letters Patent of the United States is:

1. A magazine doubler for carrying dual elongate magazines for ready use with a firearm comprising a body having front and rear portions and side walls defining a pair of magazine cavities for receiving respective lower ends of first and second magazines therein, each said cavity being formed by front and rear walls, an upper opening, and a bottom wall, said body being formed of a resilient material substantially conformable to each magazine received in respective said cavity, securing means disposed against said front and rear portions of said body for forcibly squeezing said body cavities to generally conform said body to outer surfaces of installed magazines in said magazine cavities to securely retain such magazines disposed in said cavities to said body.

2. The magazine doubler as defined in claim 1 further including at least a pair of spaced upwardly disposed rib members in one said cavity integral with said bottom wall of said one cavity for contacting a bottom of a magazine disposed therein for positioning such magazine at a predetermined height with respect to another magazine disposed in another said cavity.

3. The magazine doubler as defined in claim 1 wherein other said bottom wall of other said cavity has at least a pair of spaced upwardly disposed rib members in said other cavity for contacting a bottom of a magazine disposed therein for positioning the height of such magazine at a predetermined height with respect to said upper opening of said other cavity.

4. The magazine doubler as defined in claim 3 wherein said at least a pair of rib members in said one cavity extend upwardly a distance greater than other said at least a pair of said rib members in said other cavity to provide that a magazine disposed in said one cavity extends upwardly a greater height than a magazine disposed in said other cavity.

5. The magazine doubler as defined in claim 1 wherein said securing means includes spaced elongate members, said securing means including a bracket mounted against said rear walls of said cavities, said securing means further including a plurality of flanges adjacent said front walls of said cavities, said elongate members being defined by a plurality of threaded fasteners mounted between said bracket and each said flange to force said bracket against said rear walls and to force said front walls against magazines carried within said cavities.

6. The magazine doubler as defined in claim 5 wherein said bracket includes a substantially rectangular plate having inside and outside surfaces, a pair of spaced parallel bracket walls projecting laterally from said interior surface, a plurality of laterally extending bosses disposed between said bracket walls, each said boss having an opening therethrough disposed in alignment with said respective fasteners for passage of respective said fastener therethrough.

7. The magazine doubler as defined in claim 6 wherein said rear portion of said body includes a pair of spaced rear walls and a plurality of recessed vertically spaced walls continuous with and disposed between said rear walls of said body, each said rear wall of said body carrying one of said plurality of said flanges.

8. The magazine doubler as defined in claim 7 wherein said pair of spaced bracket walls is locatable between said rear walls of said body to provide contact between said interior surface of said plate and said rear walls.

9. The magazine doubler as defined in claim 1 wherein said bottom wall of said body is arcuate in shape from one said side wall to other said side wall.

10. A magazine doubler for carrying dual elongated magazines disposed side-by-side for ready use with a firearm comprising a flexible body including front and rear portions and side walls having a first and second cavity for receiving respective lower ends of first and second magazines therein, each said cavity being defined by a substantially flat front wall and an arcuate outer rear wall, an upper opening, and a bottom wall, one said bottom wall of said first cavity having a plurality of upwardly disposed spaced ribs in said first cavity for contacting a bottom of a magazine disposed therein for positioning such magazine at a predetermined height with respect to another magazine disposed in another said cavity, and securing means disposed against said front and rear portions of said body, movable to compress against said front and rear portions to retain such magazines disposed in said cavities between said front and rear portions of said body.

11. The magazine doubler as defined in claim 10 wherein said bottom wall of said second cavity has a plurality of upwardly disposed spaced ribs for contacting a bottom of a magazine disposed therein for controlling the height of such disposed magazine with respect to said upper opening of said second cavity.

12. The magazine doubler as defined in claim 11 wherein each said rib in said one cavity extends upwardly a distance greater than other said ribs in said other cavity to provide that a magazine disposed in said first cavity extends upwardly a greater height above said upper opening of said first cavity than the height above said upper opening of said second cavity of a magazine disposed in said second cavity.

13. The magazine doubler as defined in claim 10 further including securing means for removably securing a magazine in a respective said cavity, said first member including a bracket mounted against said front portion of said body, said rear portion of said body including a plurality of flanges, threaded fastener means attached between said bracket and said flanges for forcing said front and rear portions against each magazine carried in said body for securing such magazine.

14. The magazine doubler as defined in claim 10 wherein said bottom wall of said body is arcuate in shape from one said side wall to other said side wall.

15. A magazine doubler for carrying dual elongate magazines for ready use with a firearm comprising a body having front and rear portions and side walls defining a pair of spaced magazine cavities disposed side-by-side for receiving respective lower ends of first and second magazines therein, each said cavity being formed by front and arcuate rear walls substantially conforming to a rear wall of a magazine, an upper opening, and a bottom wall, said body being formed of a resilient material for substantially conforming said cavities to each magazine received in respective said cavity, securing means disposed against said front and rear walls of said cavities, said securing means including spaced members and means for selectively moving said members toward each other to squeeze against said front and rear walls to generally conform said cavities to magazines in said cavities to secure magazines disposed in said cavities to said body.

16. The magazine doubler as defined in claim 15 further including at least three upwardly disposed rib members in each said cavity adjacent each said front wall and said rear wall integral with respective said bottom wall of each corresponding said cavity for contacting a bottom of a magazine disposed therein for positioning such magazine at a predetermined height with respect to another magazine disposed in another said cavity.

17. The magazine doubler as defined in claim 16 further including a medially located boss member in each said cavity integral with and upwardly disposed from each said bottom wall, the height of each said boss being substantially equal to the height of said ribs in respective said cavity for supporting the floor plate of a magazine disposed in said respective cavity.

18. The magazine doubler as defined in claim 15 further including an ammunition control device slidingly attachable to a magazine for preventing the dislodging forwardly of the top round in a magazine, said ammunition control device including a blocking element locatable in the top space in a magazine.

19. The magazine doubler as defined in claim 18 wherein said ammunition control device includes a biasing member attached to said securing means for pulling said blocking element away from magazine when said element is moved out of the top space in a magazine.

20. The magazine doubler as defined in claim 15 wherein said bottom wall of said body is arcuate in shape from one said side wall to other said side wall.

* * * * *